US005396960A

United States Patent [19]

Marcott et al.

[11] Patent Number: 5,396,960

[45] Date of Patent: Mar. 14, 1995

[54] VENT GAS FLAME SUPPRESSING APPARATUS FOR OFFSHORE OIL AND GAS PRODUCING PLATFORMS

[75] Inventors: Jerry J. Marcott, Jeanerette; Loyd Guimbellot, Patterson, both of La.

[73] Assignee: Texaco Inc., White Plains, N.Y.

[21] Appl. No.: 41,927

[22] Filed: Apr. 2, 1993

Related U.S. Application Data

[63] Continuation of Ser. No. 741,367, Aug. 7, 1991, abandoned.

[51] Int. Cl.[6] ..... A62C 3/06

[52] U.S. Cl. ..... 169/54; 431/145; 431/202

[58] Field of Search ..... 169/5, 16, 43, 46, 48, 169/54, 69, 70; 239/424, 433, 601; 431/145, 202

[56] References Cited

U.S. PATENT DOCUMENTS

| | | | |
|---|---|---|---|
| 2,041,394 | 5/1936 | Belcher | 169/69 X |
| 4,120,637 | 10/1978 | Reed | 431/202 X |
| 4,194,570 | 3/1980 | Arencibia, Jr. | 169/69 X |

*Primary Examiner*—David M. Mitchell
*Assistant Examiner*—Andrew C. Pike
*Attorney, Agent, or Firm*—Kenneth R. Priem; James L. Bailey

[57] ABSTRACT

A flame extinguishing apparatus cooperates with a flare boom conductor discharge port to vent a stream of combustible gas into the atmosphere. The apparatus includes a nozzle, positioned in and adjacent to the flare boom conductor gas discharge port, directing a shaped stream of a flame impeding fluid toward the discharge port. The fluid stream thus forms a gas penetrable quasi-barrier which extinguishes the flame and concurrently dilutes the vent gas.

1 Claim, 3 Drawing Sheets

VENT GAS FLAME SUPPRESSING APPARATUS FOR OFFSHORE OIL AND GAS PRODUCING PLATFORMS

This application is a continuation of application Ser. No. 07/741,367, filed Aug. 7,1991, now abandoned.

BACKGROUND

Virtually, any well which produces liquid hydrocarbons, such as crude oil, also produces a residual amount of natural gas and water. In the normal production or drilling facility, low pressure vent gas, if presently in a limited quantity, is discharged into the atmosphere rather than being saved or otherwise used for commercial purposes.

In the instance of offshore producing facilities, this residual gas is dissipated into the air by way of one or more flare booms which extend outwardly from the offshore structure. A flare boom is normally furnished to each offshore platform such that vented gas is carried away from the platform by prevailing wind, rather than being blown back onto the structure.

The term vent gas as herein utilized refers to that portion of the gas which is raised from a producing operation, but is at an insufficient pressure and/or insufficient quantity to warrant being conserved.

Since this residual natural gas is combustible and normally combustion supporting, it can constitute a danger to the platform from both a safety consideration as well as a health consideration for the workers.

Once the gas enters the atmosphere it usually becomes sufficiently diluted to be safe from further ignition. Even so, the gaseous mixture formed at the flare boom discharge port can be readily ignited into an open flame by natural causes, such as by a flash of lightening. Offshore platforms or structures are normally isolated in a body of water. It stands to reason that in the event of an electrical storm, the accompanying lightning could constitute a flame-triggering medium for the vented gaseous mixture.

As a matter of practicality, in the Gulf of Mexico it is not an uncommon event for the vented gas to be ignited by lightning during an electrical storm. To extinguish the resulting flame, however, often constitutes a difficult procedure due to the flare boom structure extending outwardly over the water, and the lack of a convenient mechanism for extinguishing the flame. Further, flare booms are normally installed at an elevated angle of about 30° such that the vent gas stream will be released in an upward direction.

DESCRIPTION OF THE PRIOR ART

The prior art has dealt with the number of ways and methods for extinguishing a gas-fueled flame issuing from a conductor or vent pipe. None, however, have addressed to the aspect of treating the fuel gas in a safe manner to first deprive the flame of a source of combustible matter, and thereafter to dilute the fuel gas to the point where the resulting mixture will not support further combustion.

In U.S. Pat. No. 4,194,570, Arencibia, Jr. for example, a method and apparatus are disclosed for driving the exiting gas backward through its conductor or vent pipe utilizing a pressurized inert gas or a liquid to cutoff the flames capability to burn. Thereafter, the inert gas will purge the vent conductor.

BRIEF STATEMENT OF THE INVENTION

Toward overcoming this potential danger to the well-being and safety of offshore platform workers, as well as to the structure itself, the present invention provides means for utilizing a flame suppressing or impeding fluid to readily extinguish a gas fed flame which has been ignited by lightning or by a similar natural event.

The flame extinguishing or snuffing apparatus is comprised primarily of a nozzle which is located in the vent gas conduit, at a point adjacent to the discharge port at the end of the latter. The nozzle is provided with a flow of a non-flame supporting fluid, hereinafter referred to as a flame suppressant or flame impeding fluid, such as water or nitrogen. Flow of the flame snuffing fluid can be initiated manually or automatically.

The nozzle's fluid discharge side includes one or more openings which are directed toward the gas conduit discharge port, and which are arranged to form the outflowing fluid into a dynamic curtain or quasi-barrier which extends transversely of the vent gas conduit. The flame suppressing fluid is metered to the nozzle at a sufficient rate to define the dynamic curtain which remains in one position, contacting the vent gas conduit discharge lip.

The terms "curtain" and "quasi-barrier" as herein used refer to a dynamic, outwardly directed spray of the flame impeding fluid in such a volume and at such a pressure as to allow penetration thereof by the vent gas stream.

The flame suppressing or impeding fluid accomplishes two essential functions. Firstly, it causes the flame to be extinguished by interrupting or forming a curtain or quasi-barrier to impede the flow of combustible gas mixture from the source. Secondly, it acts as a diluting medium by intermixing with the vented gas to transform the latter into a condition where it cannot be readily ignited. However, even if ignited, the diluted gas will be incapable of supporting combustion.

It is therefore a primary object of the invention to provide a flame snuffing apparatus which is incorporated into a flare boom structure, which apparatus is capable of quickly and readily extinguishing an inadvertently ignited flame at the discharge end of a flare boom vent gas tube.

Figure 1:
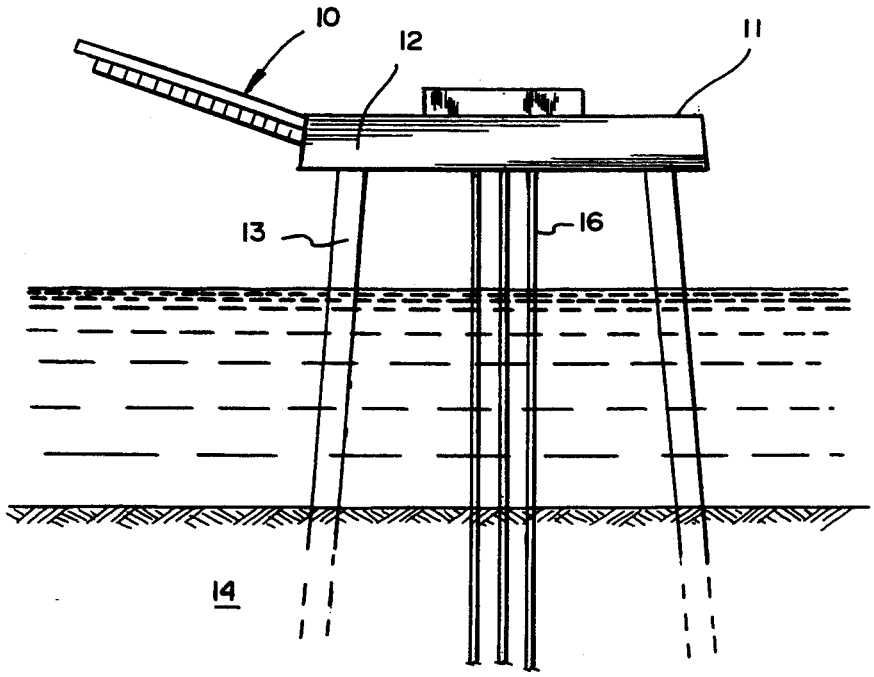
FIG. 1 is an elevational view of the invention as incorporated into an offshore structure.

Referring to the figures, a flare boom 10 of the type contemplated is shown in FIG. 1 extending from one side of an offshore platform 11 which is generally isolated from other platforms in the body of water. Platform 11 comprises a structure formed basically of a working deck 12 which is supported above the water's surface by one or more legs 13. The latter are normally aligned in a substantially upright disposition, the lower ends being embedded into the substrate 14 to a sufficient depth to assure stability of the platform.

During a normal hydrocarbon producing operation, the combined flow of liquid crude oil, together with a limited amount of water and an amount of reservoir gas, will be carried to deck 12 by a series of risers 16. The latter communicate with a subterranean reservoir holding the fluid being produced.

At deck 12, the production flow will be introduced to a separator (not shown) which physically segregates a major part of the water and the crude oil from vent gas. The latter is then passed into the atmosphere by way of one or more flare booms 10 which extend outwardly over the water from the platform structure.

Figure 2:
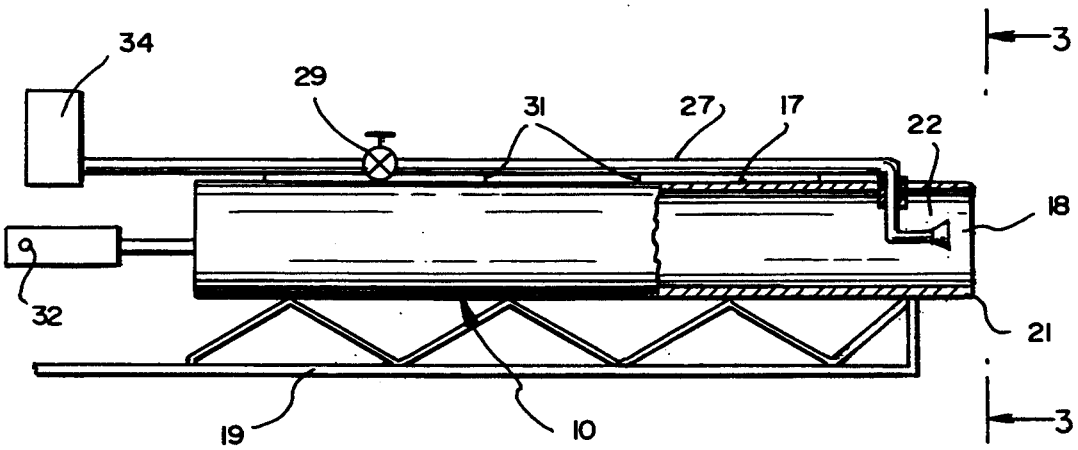
FIG. 2 is an enlarged view in partial longitudinal section, of a flare boom.

Basically, a flare boom of the type contemplated is shown in FIG. 2, wherein an elongated vent gas conductor or conduit 17 is communicated at its upstream end with a source 32 of the gas to be vented. The latter can be a tank, a reservoir, a separator, or the like. Depending on the volume of gas to be disposed of, conductor 17 can be a pipe or tubing on the order of magnitude of six or more inches in diameter formed of a steel or other suitable material.

Flare boom 10 normally extends outwardly across the water such that its remote discharge port 18 is positioned about 50 to 100 feet from the platform. Discharge port 18, formed by a lip 21, preferably lies in a plane normal to the longitudinal axis of conductor 17. The lip is sharp-edged to best accommodate the stream of flame suppressing fluid which will be impinged thereagainst as hereinafter disclosed.

Flare boom 10 is provided with sufficient bracing or support structure 19 to assure structural rigidity in view of the boom's cantilevered relationship with deck 12.

Figure 3:
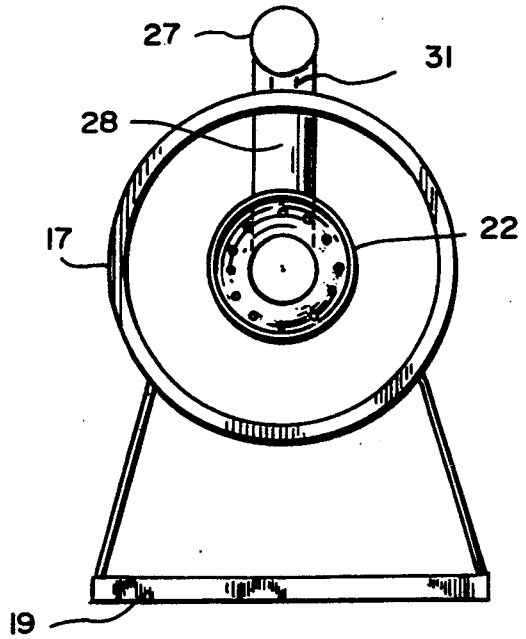
FIG. 3 is an end view taken along line 3—3 of FIG. 2.
Figure 4:
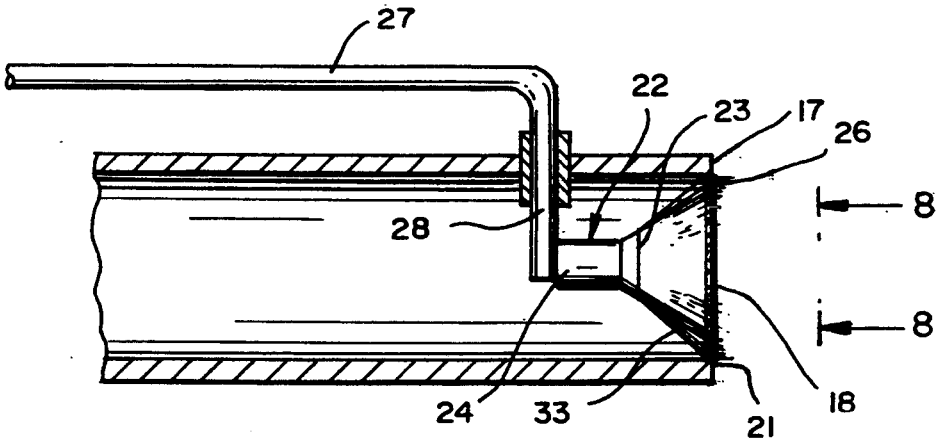
FIG. 4 is an enlarged segmentary view in longitudinal section of the flare boom in FIG. 2.
Figure 8:
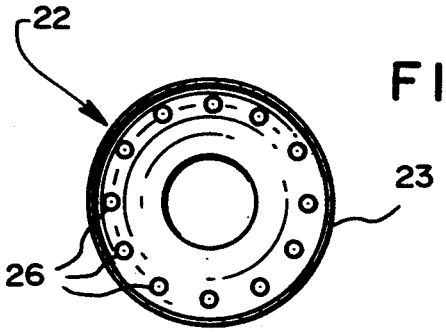
FIG. 8 is an end view taken along lines 8—8 in FIG. 4.
Figure 9:
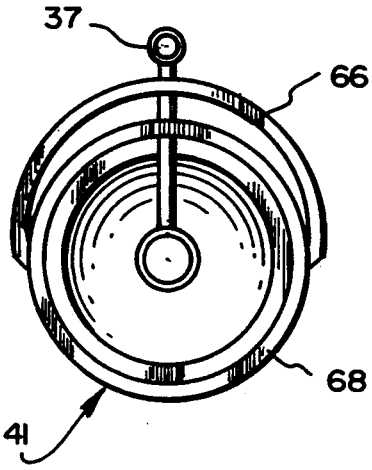
FIG. 9 is an end view taken along line 9—9 of FIG. 5.

Referring to FIGS. 3,4, and 8, the flame extinguishing segment of the unit is comprised primarily of a nozzle or fluid dispenser 22 which is positioned in conductor 17, adjacent to the discharge port 18, being slightly upstream thereof. As shown, nozzle 22 in one embodiment is comprised basically of a fluid outlet generally in the form of an outwardly flared conical section 23. This section communicates with nozzle body 24 and can include at least one annular port, and preferably a plurality of circularly patterned discharge ports 26.

Nozzle 22 inlet is coupled to a connector pipe 28 which sealably transverses the wall of vent gas conductor 17 and communicates with a second conduit 27. Conduit 27 is comprised of an elongated pipe or tubing of sufficient diameter to conduct the necessary flow of flame suppressing medium. It is further provided with a control valve 29 which can be remotely, or manually, operated to vary the pressure and/or the volume flow of the flame suppressing fluid delivered to the nozzle 22 from fluid source 34.

Conduit 27 is supported along its length by spaced apart brackets 31 which depend from conductor 17.

Valve 29 is preferably positioned on the platform structure in a readily accessible location and communicates with the pressurized source 34 containing the flame suppressing medium such as water, or a gaseous medium such as nitrogen.

When required to extinguish a flame, the flow of gas impeding fluid is metered from its pressurized source 34 by adjustment of control value 29, to discharge a desired volumetric flow of the suppressant toward discharge port 18. Discharge ports or apertures 26 of nozzle 22 are so arranged to form the discharging fluid into a curtain, or gas permeable quasi-barrier 33 which extends transversely of vent gas conductor 17.

In one embodiment of nozzle 22, the flame suppressant discharge aperture is defined by a single, annular opening formed in the nozzle's downstream face (not shown). The issuing flame suppressant fluid will thereby define a substantially conically shaped, gas permeable barrier 33. The dynamic flow conditions of the quasi-barrier will not deter the flow of vent gas along conductor 27; rather it will promote the exiting gas stream to intermix with, and thus be diluted by, the suppressant fluid.

To be most effective in achieving its dual function, the suppressant fluid is discharged from nozzle 22 in a manner to minimize the volume of fluid used. Particularly, in the instance of water, it is desirable to discharge only the amount of water needed to quench the flame, and then to saturate or dilute the vent gas.

Preferably, the water curtain is formed by minimizing the size of water droplets which leave nozzle 22. A more desirable procedure is to atomize the fluid stream through an aperture or apertures so shaped to form a spray of fine droplets.

Injection of the flame suppressant medium stream transversely of conductor 27 will be maintained only for a sufficient time period necessary to extinguish the flame. Further, the impinging fluid will function to cool the flare boom tip to a temperature below the vent gas auto-ignition temperature. Thus, when the suppressant fluid flow is stopped, the diluted vent gas will not reignite as a result of contact with a hot section of the conductor 17 wall.

In the instance of either water or inert gas as the flame impeding medium, nozzle 22 is preferably positioned coaxially of conductor 17, to assure that the dynamic curtain or quasi-barrier 33 formed by the fluid will impinge against contiguous walls of conductor 17. Unless a substantially complete annular curtain is so formed, some of the vent gas could escape through parts of discharge port 18 without intermixing, thereby sustaining the gas fed flame in spite of the introduction of the flame suppressant fluid.

Referring to FIG. 4, nozzle 22 is preferably located substantially co-axial of conductor 17 to form the desired fluid barrier 33. The latter, when properly directed to impinge against discharge port lip 21, will perform its primary function of interrupting the normally uninterrupted flow of combustible vent gas. It will concurrently alter the composition of said gaseous flow as it leaves the conductor, resulting in a non-combustion supporting mixture. By so doing, the flame downstream of discharge port 18 will be deprived of its combustion supporting feature and revert again to a gaseous outflow.

At this point, and after cooling of the vent conductor lip 21, the flow of flame suppressing fluid can be discontinued.

The volumetric flow of flame suppressant fluid to nozzle 22 constitutes a pertinent factor in assuring the integrity of the flame extinguishing procedure. It is understandable and as noted herein, said fluid flow is alterable by adjustment of control valve 29. Preferably, this flow control adjustment is exercised by an operator who visually monitors the flame condition at the flare boom discharge end.

Figure 5:
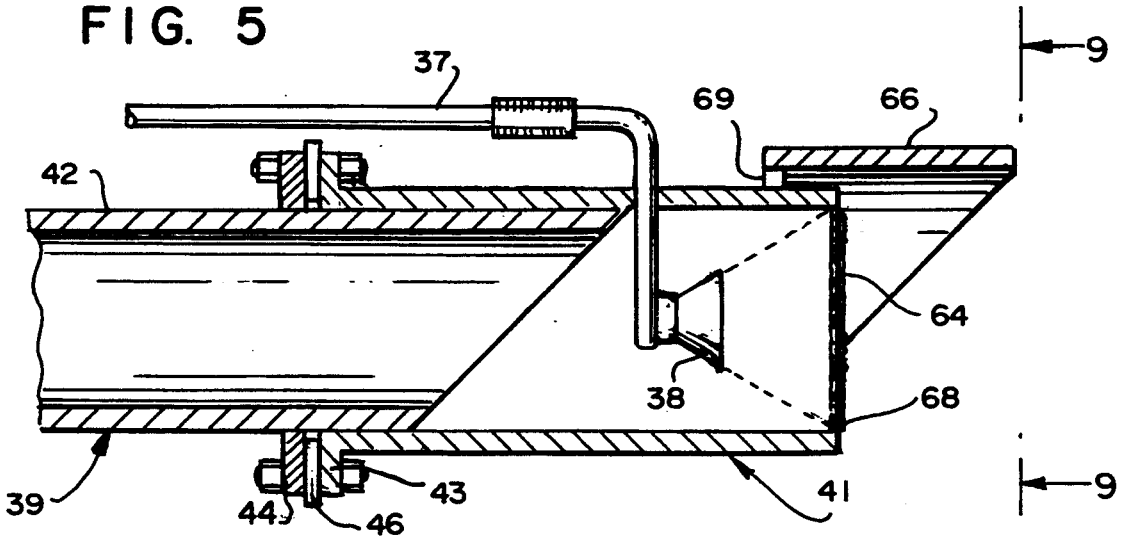
FIG. 5 illustrates an alternate embodiment of the invention.

Referring to FIG. 5, in an alternate embodiment of the disclosed apparatus, the flame extinguishing feature can be incorporated into an assembly adopted for retrofitting onto the tip end of an existing flare boom 39. Connection of the existing vent gas conductor 42 to the flame extinguishing apparatus 41 is made by the placing of mating flange segments 43 and 44 to each of the units to be connected. When the flanges are bolted together against a gasketing member 46 therebetween, a gastight connection will result.

Similar to the embodiment shown in FIG. 2, retrofitting assembly 41 includes a nozzle 38 which is connected by conduit 37 to a source of flame suppressing fluid.

Figure 6:
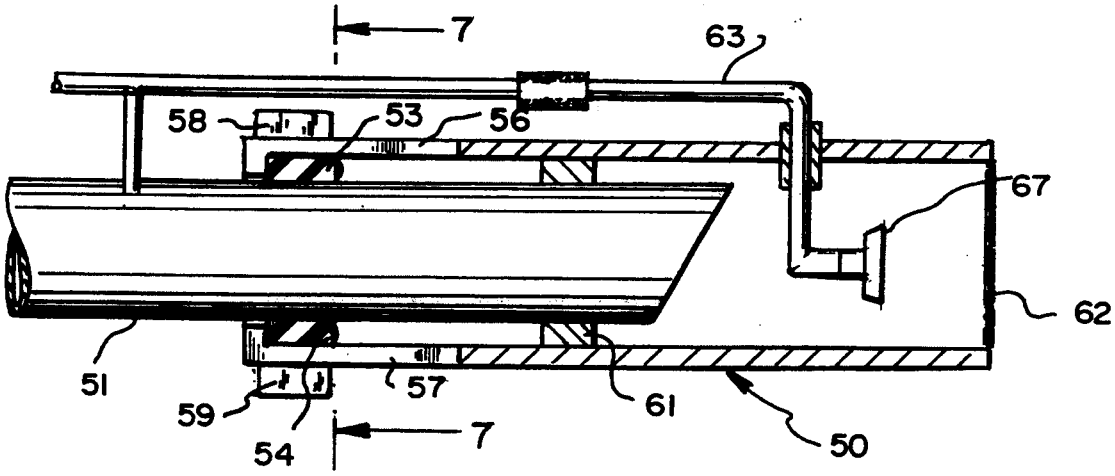
FIG. 6 illustrates a further embodiment of the invention.
Figure 7:
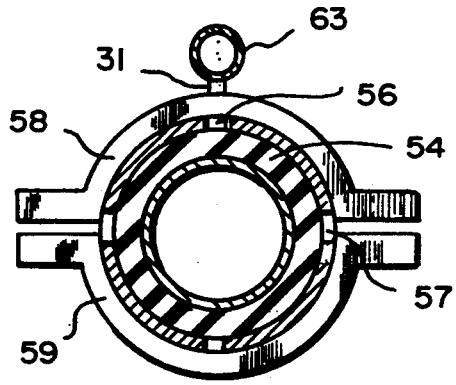
FIG. 7 is a transverse section taken along lines 7—7 in FIG. 6.

Referring to FIG. 6 and 7, a further modification of the apparatus is illustrated to facilitate adaption of a flame extinguishing supplemental tip 50 to an existing vent gas conductor 51, a similar connection can be made between the respective parts. For example, the flame extinguishing unit is comprised of a generally tubular member 52 characterized by an inner diameter greater than of the diameter of vent gas conductor 51. Tubular member 52 includes an annular groove or rim 53, which accommodates a resilient seal ring 54.

To allow the inner end of gas conductor 51 to be compressed tightly around seal ring 54, tubular member 52 is provided with a series of longitudinal slots 56 and 57 through the wall thereof. Thus, a split clamp comprised of two clamp sections 58 and 59 tighten about the slotted conductor end, thereby compressing said slotted end against the resilient ring 54. The latter is deformed to accomplish the desired annular gastight seal.

To assure the proper fitting of the supplemental tip 50 to the existing vent gas conductor 51, a rigid support ring 61 is positioned between the seal ring 54 and the discharge port 62 thereby assuring fixed positioning of the joined members.

As noted in the foregoing embodiments of the invention, a nozzle 67 is positioned in place immediately upstream of discharge port 62. The nozzle is communicated by conduit 63 to a source of the flame suppressing fluid whereby a controlled flow of the latter can be directed towards discharge port 62 to extinguish a flame.

Referring again to FIGS. 2 and 4, proper positioning of nozzle 22 relative to discharge lip 21 will dependent, at least in part, on the configuration or shape of the conical, gas permeable curtain 33. To achieve its desired junction with main conductor 17, the curtain lower edge must impinge against the sharp edge of lip 21. Thus, fluid issuing from the nozzle will define a complete curtain which is sufficiently permeable that the vent gas will penetrate, and subsequently pass from the discharge port in diluted condition. It has been found by practice, that for a 10 inch diameter conductor 17, a nozzle 22 which produces a conically shaped fluid curtain having an angle of about 120° will be positioned about 2 inches rearward of the edge of lip 21.

Proper longitudinal and axial positioning of nozzle 22 will insure discharge of all the vent gas mixture from conductor 17 in diluted form. It will also assure that when the flame suppressing fluid is a liquid, backflow thereof into tube 17 will be minimized or obviated.

Again referring to FIG. 5, to maintain the integrity of the disclosed apparatus with respect to minimizing entrance of rain or sea water spray into the flare tube discharge port, the latter is provided with a moisture deflector or shield 66. In one embodiment, the forward end of conduit 42 is fitted with a plate or hood 66, which functions to deter entry of rain water or spray into the conduit discharge port. Shield 66 is fixed to the upper side of tube 42, and extends toward the forward end of the latter, to overhang the tube discharge port 64.

Shield 66 is firmly positioned above the conduit 42 surface by a backplate 69 or similar support member. To be effectual, shield 66 extends forward of the discharge port 64 by a distance approximating the conduit's diameter.

Functionally, shield 66 is shaped to conform with the conduit 42 external contour. It is, however, positioned sufficiently from peripheral lip 68 to avoid interfering with the shaped flow of the flame suppressant fluid. Thus, the fluid barrier which contacts tube lip 68 will not be adversely influenced or deflected as a result of contacting the shield.

It is understood that although modifications and variations of the invention can be made without departing from the spirit and scope thereof, only such limitations should be imposed as are indicated in the appended claims.

We claim:

1. In combination with a flare boom having a main elongated conductor with a first end in communication with a source of flammable gas to be vented to atmosphere and a second end having a lip which defines a discharge port through which a stream of said flammable gas is passed into the atmosphere, a vent gas flame extinguishing means comprising:

a pressurized source of a flame impeding fluid; and fluid distribution means in communication with said source of the flame impeding fluid;

wherein said fluid distribution means is in said main elongated conductor positioned upstream from said lip and positioned substantially coaxially of said elongated conductor, and said fluid distribution means has at least one discharge aperture aligned to direct a stream of the flame impeding fluid toward said discharge port to define a flammable gas permeable fluid curtain transversely of said main elongated conductor.

* * * * *